US011268307B2

(12) United States Patent
Wilke et al.

(10) Patent No.: US 11,268,307 B2
(45) Date of Patent: Mar. 8, 2022

(54) ACTUATING DEVICE FOR A MOTOR VEHICLE DOOR WITH MEANS FOR REDUCING THE TRANSVERSE PLAY OF A FLUSH DOOR HANDLE HAVING EXPANDED USE POSSIBILITIES

(71) Applicant: ILLINOIS TOOL WORKS INC., Glenview, IL (US)

(72) Inventors: Zsolt Wilke, Bad Mergentheim (DE); Matthias Seubert, Giebelstadt (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 747 days.

(21) Appl. No.: 16/108,874

(22) Filed: Aug. 22, 2018

(65) Prior Publication Data

US 2019/0063120 A1 Feb. 28, 2019

(30) Foreign Application Priority Data

Aug. 25, 2017 (DE) ..... 10 2017 119 580.7

(51) Int. Cl.
*E05B 85/10* (2014.01)
*E05B 81/08* (2014.01)
*E05B 79/06* (2014.01)

(52) U.S. Cl.
CPC ..... *E05B 85/107* (2013.01); *E05B 79/06* (2013.01); *E05B 81/08* (2013.01); *E05B 85/103* (2013.01)

(58) Field of Classification Search
CPC . E05B 79/06; E05B 5/00; E05B 5/003; E05B 5/006; E05B 81/08; E05B 81/64;
(Continued)

(56) References Cited

U.S. PATENT DOCUMENTS 7,621,573 B2 * 11/2009 Thomas ..... E05B 81/76 292/336.3
7,971,913 B2 * 7/2011 Sunahara ..... E05B 85/16 292/336.3

(Continued)

FOREIGN PATENT DOCUMENTS

CN 103132784 A 6/2013
DE 102008019335 A1 * 10/2008 ..... E05B 85/107

(Continued)

*Primary Examiner* — Kristina R Fulton
*Assistant Examiner* — Tal Saif
(74) *Attorney, Agent, or Firm* — Thompson Hine LLP

(57) ABSTRACT

An actuating device, for a motor vehicle door lock, having a handle part grippable by one hand and being movable by a mechanism from a rest position into a standby position, and being movable manually into an actuating position starting from the standby position, the actuating device configured to actuate the door lock if the handle part reaches the actuating position, the actuating device having a device for reducing a transverse play of the handle parts such that the transverse play in the standby position is reduced with respect to the transverse play in a position between the rest position and the standby position, the device for reducing the transverse play configured to completely or partially cancel again the reduction of the transverse play in the standby position if the handle part is moved from the standby position into the actuating position.

10 Claims, 3 Drawing Sheets

(58) Field of Classification Search
CPC ..... E05B 81/76; E05B 81/77; E05B 81/78; E05B 85/10; E05B 85/103; E05B 85/107; Y10T 292/57; Y10S 292/31; Y10S 292/53; Y10S 292/54; Y10S 292/57; Y10S 292/73
See application file for complete search history.

(56) References Cited

U.S. PATENT DOCUMENTS

| | | | | |
|---|---|---|---|---|
| 9,605,451 | B2 * | 3/2017 | Patel | E05B 85/16 |
| 10,563,437 | B2 * | 2/2020 | Bartels | B60Q 1/2669 |
| 10,815,702 | B2 * | 10/2020 | Yoshino | E05B 81/76 |
| 2003/0001399 | A1 * | 1/2003 | Sato | E05B 79/06 292/336.3 |
| 2011/0148575 | A1 * | 6/2011 | Sobecki | E05B 85/10 340/5.64 |
| 2011/0266816 | A1 * | 11/2011 | Kindig | E05B 85/14 292/336.3 |
| 2013/0076047 | A1 * | 3/2013 | Wheeler | E05B 5/006 292/336.3 |
| 2013/0127185 | A1 | 5/2013 | Lang | |
| 2015/0039180 | A9 | 2/2015 | Aerts | |
| 2017/0167169 | A1 * | 6/2017 | Sobecki | E05B 83/18 |
| 2018/0058114 | A1 * | 3/2018 | Brown | E05B 85/16 |
| 2018/0106082 | A1 * | 4/2018 | Brown | E05B 85/103 |
| 2018/0163442 | A1 * | 6/2018 | Soonthornwinate | E05B 83/40 |
| 2018/0274271 | A1 * | 9/2018 | Och | E05B 77/06 |
| 2019/0145134 | A1 * | 5/2019 | Low | E05B 79/06 70/208 |
| 2019/0169889 | A1 * | 6/2019 | Beck | E05B 81/76 |
| 2019/0234123 | A1 * | 8/2019 | Saitou | E05B 77/36 |
| 2019/0309547 | A1 * | 10/2019 | Och | E05B 79/06 |

FOREIGN PATENT DOCUMENTS

| | | | | |
|---|---|---|---|---|
| DE | 102009045843 | A1 * | 4/2011 | E05B 77/04 |
| DE | 102013112706 | A1 * | 5/2015 | E05B 85/103 |
| DE | 102015105644 | A1 * | 11/2015 | E05B 85/107 |
| DE | 102014114799 | A1 * | 4/2016 | B60Q 1/2669 |
| DE | 102015107793 | A1 * | 6/2016 | E05B 81/64 |
| EP | 3106596 | A1 * | 12/2016 | E05B 85/103 |
| EP | 3421699 | A1 * | 1/2019 | E05B 85/16 |
| FR | 3034802 | A1 * | 10/2016 | E05B 79/06 |
| WO | WO-2008129003 | A2 * | 10/2008 | E05B 85/107 |
| WO | WO-2011047653 | A1 * | 4/2011 | E05B 85/107 |
| WO | WO-2011086144 | A1 * | 7/2011 | E05B 85/107 |
| WO | WO-2012013599 | A1 * | 2/2012 | E05B 83/36 |
| WO | WO-2012175647 | A2 * | 12/2012 | E05B 85/107 |
| WO | WO-2016041996 | A1 * | 3/2016 | E05B 77/04 |
| WO | WO 2016/151131 | | 9/2016 | |
| WO | WO-2016151131 | A1 * | 9/2016 | E05B 85/103 |
| WO | WO-2017070307 | A1 * | 4/2017 | E05B 77/06 |

* cited by examiner

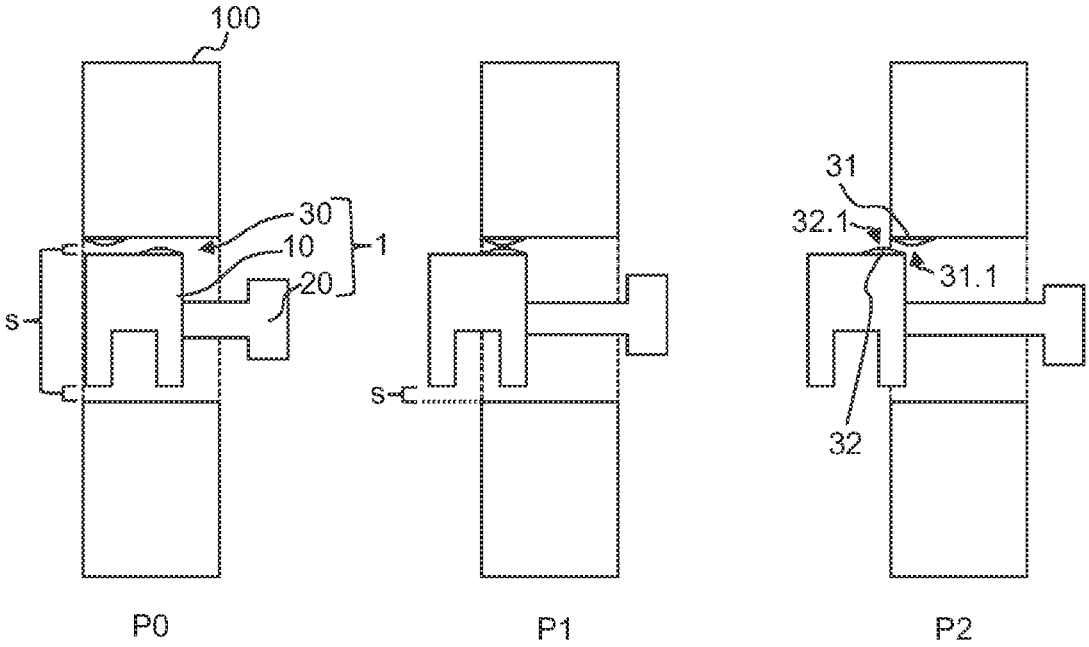
Fig. 1A Fig. 1B Fig. 1C
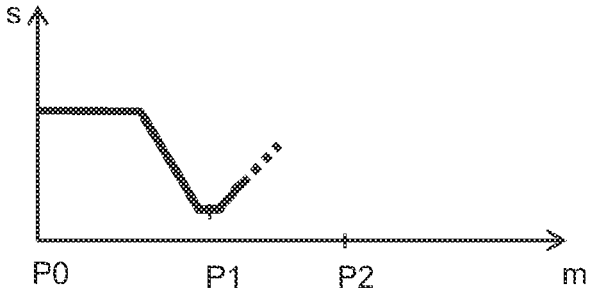
Fig. 1D
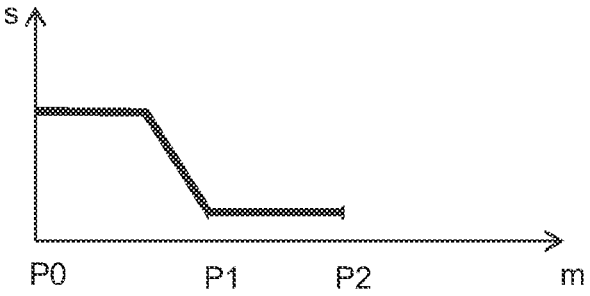
Fig. 2 – (PRIOR ART)

22

32

31

33

41

31.1

41

32.1

33

ACTUATING DEVICE FOR A MOTOR VEHICLE DOOR WITH MEANS FOR REDUCING THE TRANSVERSE PLAY OF A FLUSH DOOR HANDLE HAVING EXPANDED USE POSSIBILITIES

TECHNICAL FIELD

The invention relates to an actuating device for a motor vehicle door with a means for reducing the transverse play of a so-called flush door handle, and to a motor vehicle door.

BACKGROUND

WO2016/151131 A1 shows such an actuating device with means for reducing the transverse play. The inventors found this prior art to be disadvantageous insofar as a reduction of the transverse play with such a means is possible only at certain locations.

SUMMARY

It is an object of the present invention to improve these disadvantages. The object is achieved by the independent claims. Advantageous developments are defined in the subclaims.

In particular, the object is achieved by a motor vehicle door having an actuating device for a door lock of the motor vehicle door, the actuating device having a handle part which can be gripped by one hand, the handle part being movable by means of a mechanism, preferably a mechanism driven by means of a drive, for example a motor, from a rest position, in which the handle part is preferably arranged substantially flush with a surface of the motor vehicle door when the actuating device is in an installed state in the motor vehicle door, into a standby position, the handle part preferably projecting further from the motor vehicle door in the standby position than in the rest position when the actuating device is in an installed state in the motor vehicle door, and the handle part being movable manually into an actuating position starting from the standby position, the actuating device being configured to actuate the door lock if the handle part reaches or has reached the actuating position, the actuating device having a means for reducing a transverse play of the handle part, and, by virtue of the means for reducing the transverse play, the transverse play in the standby position is reduced with respect to the transverse play in a position between the rest position and the standby position, the means for reducing the transverse play of the handle part being configured to completely or partially cancel again the reduction, preferably induced by said means, of the transverse play in the standby position if the handle part is moved from the standby position into the actuating position.

As a result, it is in particular possible for a means for reducing transverse play also to be provided at such locations at which the handle part or mechanism is moved in order to pass from the standby into the actuating situation.

The actuating device is preferably a door inner handle device or door outer handle device.

The standby position is preferably a position in which the handle is held or can be held inoperative by means of the mechanism. In the standby position, the handle part can be manually grasped or can be better grasped than in the rest position. However, it is preferably also possible to grip the handle part in the rest position and to pull it manually into the standby situation and subsequently into the actuating situation. The handle part preferably projects further from the motor vehicle door in the actuating position than in the standby position when the actuating device is in an installed state in the motor vehicle door.

The transverse play is preferably transverse to the movement direction from the rest position to the standby position and/or actuating position. In the case of a conventionally, i.e. horizontally, installed handle, it is preferably a vertical play, i.e. in the Z direction in vehicle coordinates. It is preferably a local play of the handle part, namely locally with respect to the entire or global longitudinal extent of the handle part. In the case of a vehicle side door and a conventionally, i.e. horizontally, installed handle, the longitudinal extent of the handle part is the extent of the handle part in the X direction of the vehicle coordinate system.

In a further exemplary embodiment of the present invention, the means for reducing the transverse play has projection elements with abutment surfaces, at least one of the projection elements being arranged fixedly on the vehicle door side, for example on a supporting and/or mounting structure of the actuating device, when the actuating device is in an installed state in the motor vehicle door, and at least a further of the projection elements being arranged movably on a component, which is movable for the purpose of moving the handle part, of the mechanism or on the handle part itself, and the abutment surfaces of these two projection elements having a first spacing from one another if the handle part is situated between the rest position and the standby position, having a second spacing from one another if the handle part is situated in the standby position, and having a third spacing if the handle part is situated between the standby position and the actuating position, and the second spacing being less than the first spacing and less than the third spacing.

As a result, a means according to the invention for reducing a transverse play is realized with only a small structural and material outlay. The second spacing is preferably 0, i.e., the abutment surfaces preferably contact one another if the handle part is situated in the standby position.

In a further exemplary embodiment of the present invention, the handle part is directly or indirectly coupled to the motor vehicle door, preferably indirectly via the supporting and/or mounting structure, so as to be pivotable on one side of the handle part about a pivot axis when the actuating device is in an installed state in the motor vehicle door, and the handle part is movable by means of a pivoting movement about the pivot axis into the actuating position, the at least one movably arranged projection element being arranged on a lever arm which is arranged on the handle part so as to be offset transversely to the pivot axis, which lever arm is part of the mechanism, said projection element preferably being formed integrally with the lever arm.

As a result, the means for reducing the transverse play is arranged at the location where typically there exists a great deal of undesired freedom of movement, in the region away from the pivot axis and thus in the region of the mechanism which is moved during the pivoting movement to actuate the door lock.

In a further exemplary embodiment of the present invention, the lever arm is configured, by means of a pulling force on the lever arm introduced manually via the handle part, to execute a movement induced by this pulling force and thus to actuate the door lock, preferably mechanically, preferably via a Bowden cable.

As a result, the means for reducing the transverse play is arranged on a component, namely the lever, which cooperates directly in the actuating movement and force transmission to the door lock.

In a further exemplary embodiment of the present invention, the at least one movably arranged projection element is configured to be moved in a first movement direction if the handle part is moved, coming from the rest position, into the standby position, and to be moved in a second movement direction from the standby position further in the actuating position direction if the handle part is moved, coming from the standby position, into the actuating position, the first movement direction and the second movement direction being different and thus enclosing an angle ρ, preferably in the range from 5 degrees to 175 degrees.

As a result, a transverse play reduction according to the invention is also achieved for different movement directions. The first movement direction is preferably to be considered as the movement direction shortly before reaching the standby position coming from the rest position. The second movement direction is preferably to be considered as the movement direction shortly after leaving the standby position in the actuating position direction.

In a further exemplary embodiment of the present invention, at least two abutment surfaces enclose with the direction of the transverse play, preferably in the z direction, an angle γ of less or greater than 90° and are angled with respect to the first movement direction by an angle α, preferably greater than 5 degrees.

As a result, a positioning of the abutment surfaces that can be fixed without jamming is made possible since the abutment surfaces taper obliquely to one another if the handle is moved from the rest position into the standby position.

In a further exemplary embodiment of the present invention, the at least two abutment surfaces are additionally angled with respect to the second movement direction by an angle β, preferably greater than 5 degrees, and thus angled with respect to each of the first and second movement directions.

As a result, the same advantage (jamming-free position) is also made possible for the movement of the abutment surfaces if the handle is moved from the actuating position into the standby position.

In a further exemplary embodiment of the present invention, the means for reducing the transverse play has at least four projection elements with abutment surfaces, two projection elements of the four projection elements being fixedly arranged in an offset or aligned manner on the vehicle door side and in the direction of the transverse play to be reduced, i.e. overlapping one another at least in a subregion, and two other projection elements of the four projection elements being fixedly arranged in an offset or aligned manner on the mechanism or on the handle part itself in the direction of the transverse play to be reduced, and the two vehicle-door-side projection elements or the two projection elements arranged on the handle part or the mechanism being interconnected via a, preferably protruding, connecting web and the corresponding other two projection elements being configured to be moved in an offset or aligned manner between the projection elements interconnected via the connecting web by means of at least two different relative movement directions.

As a result, the transverse play is reduced according to the invention in two opposite directions in a simple manner.

In a further exemplary embodiment of the present invention, the corresponding other two projection elements are arranged on an edge of a vehicle-door-side component on the upper and lower side of the component, preferably on an edge of a cutout incorporated into the support and/or mounting structure, and the connecting web bridges the edge and the connecting web positions the projection elements interconnected by the connecting web over the upper side and under the lower side of the component.

As a result, it is possible in a simple manner for an already existing edge or an additionally incorporated edge, for example that of a cutout, to be used for arranging the vehicle-door-fixed projection element pair.

The object is furthermore achieved in particular by an actuating device according to the invention, preferably as is defined in one of the exemplary embodiments, for a motor vehicle door and/or a door lock of the motor vehicle door.

BRIEF DESCRIPTION OF THE DRAWINGS

The invention will now be further illustrated by way of example with reference to drawings, in which:

FIGS. 1A-1C show a basic diagram of a motor vehicle door with actuating device with the handle part in different positions, FIG. 1D shows a diagram with an example of the profile of the transverse play resulting according to the invention, for example resulting for the actuating device from FIGS. 1A-1C, FIG. 2 shows a diagram with the profile of the transverse play as would (roughly) be obtained from the cited prior art.

DETAILED DESCRIPTION

Figure 3A:
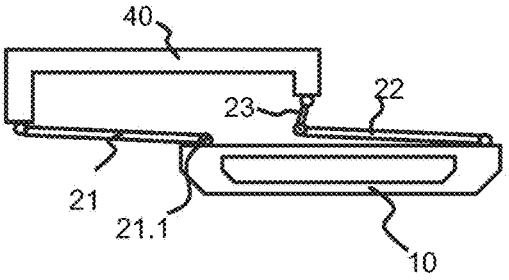
FIGS. 3A-3I show a detailed illustration of a further exemplary embodiment of an actuating device according to the invention.

FIGS. 1A-1C show a basic diagram of a motor vehicle door 100 with actuating device 1 with the handle part 10 in different positions: rest position P0, FIG. 1A; standby position P1, FIG. 1B; actuating position P2, FIG. 1C. The actuating device 1 has a handle part 10 which can be gripped by one hand. The handle part 10 is movable by means of a mechanism 20 from a rest position P0, in which the handle part is arranged substantially flush with a surface of the motor vehicle door when the actuating device is in an installed state in the motor vehicle door, into a standby position P1. The handle part 10 projects further from the motor vehicle door in the standby position than in the rest position P0 when the actuating device 1 is in an installed state in the motor vehicle door. The handle part 10 is movable manually into an actuating position P2 starting from the standby position P1. The actuating device 1 is configured to actuate the door lock if the handle part 10 reaches or has reached the actuating position P2. The actuating device 1 has a means for reducing a transverse play s of the handle part 10. By virtue of the means 30 for reducing the transverse play, the transverse play s in the standby position P1 is reduced with respect to the transverse play s in a position between the rest position P0 and the standby position P1. The means 30 for reducing the transverse play of the handle part 10 is configured to completely or partially cancel again the reduction, induced by said means, of the transverse play s in the standby position P1 if the handle part 10 is moved from the standby position P1 into the actuating position P2. The means for reducing the transverse play s has projection elements 31, 32 with abutment surfaces 31.1, 32.1, at least one of the projection elements 31, 32 being arranged fixedly on the vehicle door side when the actuating device 1 is in an installed state in the motor vehicle door. At least one further of the projection elements 31, 32 is arranged movably on a component, which is movable for the purpose of moving the handle part 10, of the mechanism 20 or on the handle part 10 itself. The abutment surfaces 31.1, 32.1 of these two projection elements 31, 32 have a first spacing from one another if the handle part 10 is situated between the rest position and the standby position, a second spacing from one another if the handle part 10 is situated in the standby position, and a third spacing if the handle part 10 is situated between the standby position and the actuating position. The second spacing is less than the first spacing and less than the third spacing.

FIG. 1D shows a diagram with an example of the profile of the transverse play resulting according to the invention, for example resulting for the actuating device from FIGS. 1A-1C. It can be seen that the transverse play increases again after the handle part 10 has left the standby position P1 in the direction P2.

FIG. 2 shows a diagram with the profile of the transverse play as would be (roughly) obtained from the cited prior art. It can be seen that the reduced transverse play induced by the means for reducing the transverse play does not increase again in the direction P2.

Figure 3B:
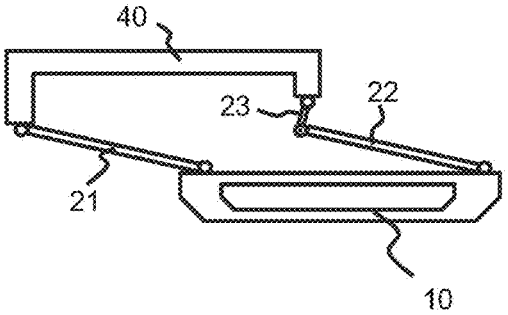
Figure 3C:
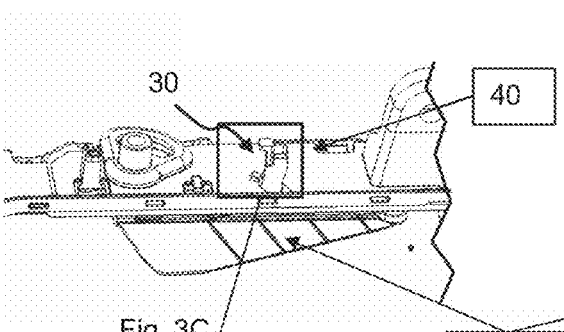
Figure 3D:
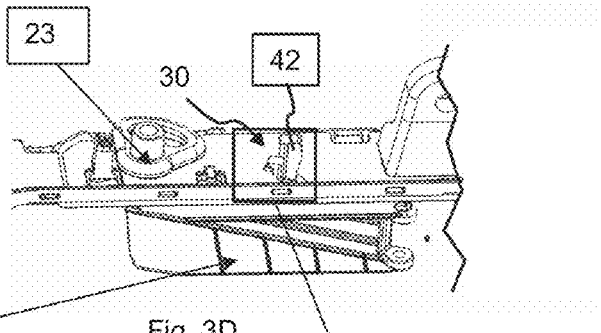
Figure 3E:
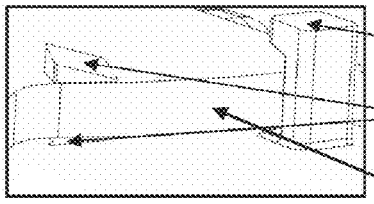
Figure 3F:
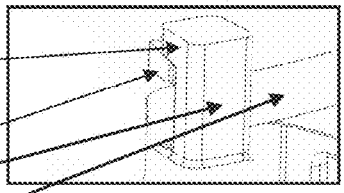
Figure 3G:
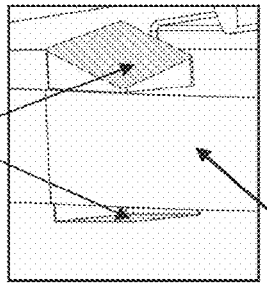
Figure 3H:
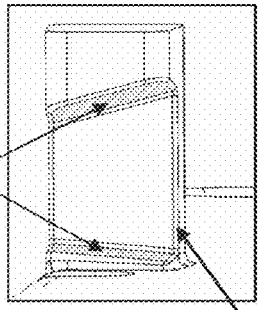
Figure 3I:
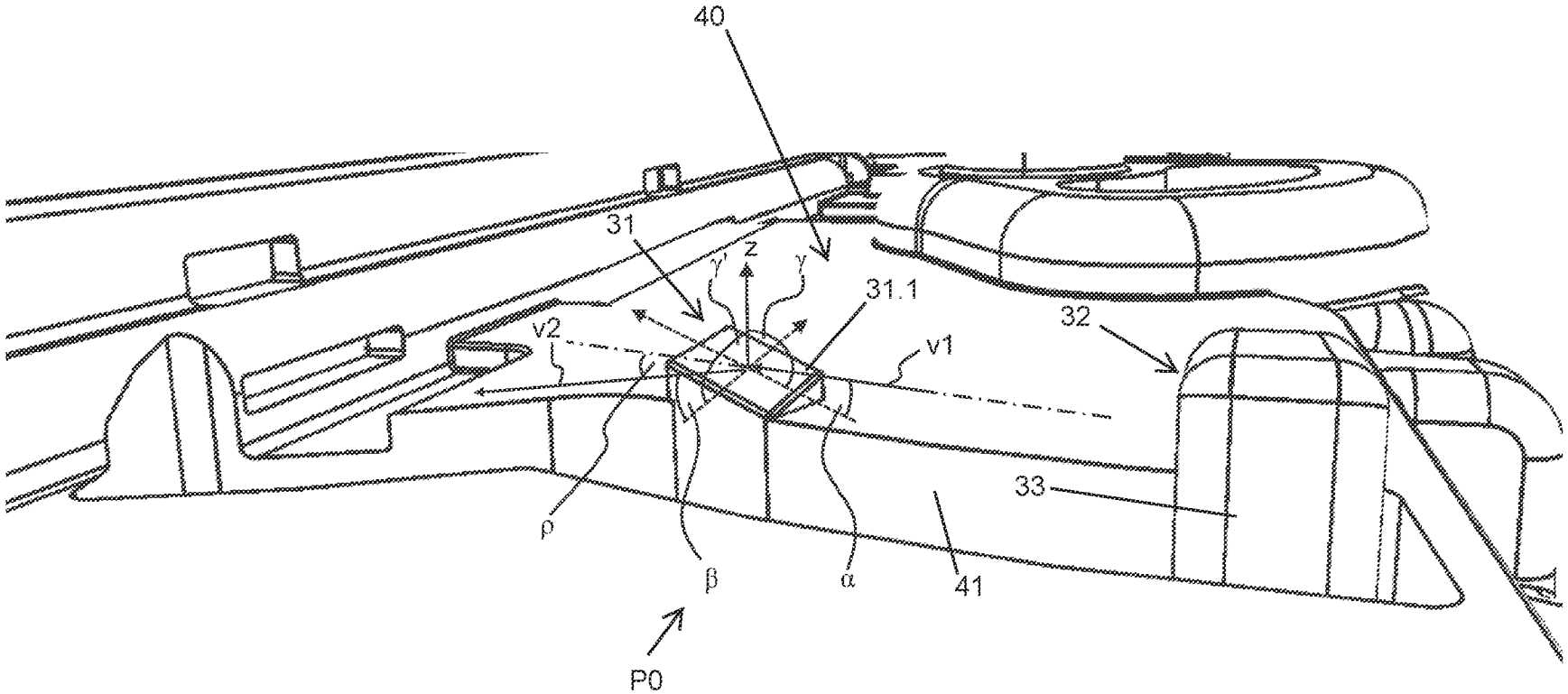

FIGS. 3A-3I show a detailed illustration of a further exemplary embodiment of an actuating device according to the invention. FIGS. 3A, 3C, 3E, 3G, 3I show the kinematics (FIG. 3A) or other details in the rest position P0, and FIGS. 3B, 3D, 3F show the kinematics (FIG. 3B) or other details in the standby position P1. FIGS. 3C and 3D show in perspective a view obliquely from the front of the region of the actuating device 1 which contains the lever arm 22 and the means 30 for reducing the transverse play, the handle part 10 being blanked out. FIGS. 3E, 3F show an enlargement in the form of a detail with the projection elements 31, 32, FIG. 3G shows an enlargement in the form of a detail of the projection element 31, and FIG. 3H shows an enlargement in the form of a detail of the projection element 32. FIG. 3I shows a view obliquely from above of the region of the actuating device 1 which contains the lever arm 22 and the means 30 for reducing the transverse play. The actuating device 1 has the described features of the device 1 from FIGS. 1A-1D. The vehicle-door-side projection elements 31 are arranged on a supporting and/or mounting structure 40 of the actuating device 1. The handle part 10 is indirectly coupled via the supporting and/or mounting structure 40 to the motor vehicle door 100 so as to be pivotable on one side of the handle part 10 about a pivot axis 21.1 when the actuating device 1 is in an installed state in the motor vehicle door. The handle part 10 is movable by means of a pivoting movement about the pivot axis 21.1 into the actuating position P2. The at least one movably arranged projection element 32 is arranged on a lever arm 22 which is arranged offset transversely to the pivot axis 21.1 on the handle part 10, which lever arm is part of the mechanism 20. The projection element 32 is formed integrally with the lever arm 22. The lever arm 22 is configured, by means of a pulling force on the lever arm 22 introduced manually via the handle part 10, to execute a movement induced by this pulling force and thus to actuate the door lock mechanically and via a Bowden cable.

The at least one movably arranged projection element 32 is configured to be moved in a first movement direction v1—see FIG. 3I—if the handle part 10 is moved, coming from the rest position P0, into the standby position P1, and to be moved in a second movement direction v2 from the standby position P1 further in the direction of the actuating position P2 if the handle part 10 is moved, coming from the standby position P1, into the actuating position P2. The first movement direction v1 and the second movement direction v2 are different and thus enclose an angle ρ of about 35 degrees. At least two abutment surfaces 31.1, 32.1 enclose with the direction of the transverse play, here in the z direction, an angle γ of less or greater than 90° and are angled with respect to the first movement direction v1 by an angle α of 10 degrees. The at least two abutment surfaces 31.1, 32.1 are additionally angled with respect to the second movement direction v2 by an angle β of about 10 degrees and thus angled with respect to each of the first and second movement directions v1, v2.

The means for reducing the transverse play s here has a total of four projection elements 31, 32 with abutment surfaces 31.1, 32.1. Two projection elements 31 of the four projection elements 31, 32 are fixedly arranged in an aligned manner on the vehicle door side and in the direction of the transverse play s to be reduced. Two other projection elements 32 of the four projection elements 31, 32 are fixedly arranged in an aligned manner on the mechanism 20 in the direction of the transverse play s to be reduced. The two projection elements 32 arranged on the mechanism 20 are interconnected via a protruding connecting web 33. The corresponding other two projection elements 31 are configured to be moved in an aligned manner between the projection elements 32 interconnected via the connecting web 33 by means of at least two different relative movement directions v1, v2. The corresponding other two projection elements 31 are arranged on an edge 41 of a cutout 42 incorporated into the supporting and/or mounting structure 40. The connecting web 33 bridges the edge 41 and the connecting web 33 positions the projection elements 32 interconnected by the connecting web 33 over the upper side and under the lower side of the supporting and/or mounting structure 40.

LIST OF REFERENCE SIGNS

1 Actuating device
10 Handle part
20 Mechanism
21 Lever arm
21.1 Pivot axis
22 Lever arm
23 Pivot element
30 Means for reducing a transverse play
31 Projection element
31.1 Abutment surface
32 Projection element
32.1 Abutment surface
33 Connecting web
40 Supporting and/or mounting structure
41 Edge
42 Cutout
100 Motor vehicle door
P0 Rest position
P1 Standby position
P2 Actuating position
m Movement
s Transverse play
α Angle between abutment surface and first movement direction
β Angle between abutment surface and second movement direction
γ Angle between transverse play direction and abutment surface
ρ Angle between movement directions

The invention claimed is:

1. A motor vehicle door (100) having an actuating device (1) for a door lock of the motor vehicle door, the actuating device (1) having a handle part (10) which can be gripped by one hand, the handle part (10) being movable by means of a mechanism (20) from a rest position (P0) into a standby position (P1), and the handle part (10) being movable manually into an actuating position (P2) starting from the standby position (P1), the actuating device (1) being configured to actuate the door lock if the handle part (10) reaches or has reached the actuating position (P2), the actuating device (1) having a means for reducing a transverse play (s) of the handle part (10), and, by virtue of the means (30) for reducing the transverse play, the transverse play (s) in the standby position (P1) is reduced with respect to the transverse play (s) in a position between the rest position (P0) and the standby position (P1), wherein the means (30) for reducing the transverse play of the handle part (10) is configured to completely or partially cancel again the reduction of the transverse play (s) in the standby position (P1) if the handle part (10) is moved from the standby position (P1) into the actuating position (P2).

2. The motor vehicle door (100) as claimed in claim 1, the means for reducing the transverse play (s) having projection elements (31, 32) with abutment surfaces (31.1, 32.1), at least one of the projection elements (31, 32) being arranged fixedly on the vehicle door side when the actuating device (1) is in an installed state in the motor vehicle door, and at least a further of the projection elements (31, 32) being arranged movably on a component, which is movable for the purpose of moving the handle part (10), of the mechanism (20) or on the handle part (10) itself, and the abutment surfaces (31.1, 32.1) of these two projection elements (31, 32)

having a first spacing from one another if the handle part (10) is situated between the rest position and the standby position, having a second spacing from one another if the handle part (10) is situated in the standby position, and having a third spacing if the handle part (10) is situated between the standby position and the actuating position, and the second spacing being less than the first spacing and less than the third spacing.

3. The motor vehicle door (100) as claimed in claim 2, the handle part (10) being directly or indirectly coupled to the motor vehicle door (100) so as to be pivotable on one side of the handle part (10) about a pivot axis (21.1) when the actuating device (1) is in an installed state in the motor vehicle door, and the handle part (10) being movable by means of a pivoting movement about the pivot axis (21.1) into the actuating position, the at least one movably arranged projection element (32) being arranged on a lever arm (22) which is arranged so as to be offset transversely to the pivot axis (21.1) on the handle part (10), wherein the lever arm (22) is part of the mechanism (20).

4. The motor vehicle door (100) as claimed in claim 3, the lever arm (22) being configured, by means of a pulling force on the lever arm (22) introduced manually via the handle part (10), to execute a movement induced by this pulling force and thus to actuate the door lock.

5. The motor vehicle door (100) as claimed in claim 2, the at least one movably arranged projection element (32) being configured to be moved in a first movement direction (v1) if the handle part (10) is moved, coming from the rest position, into the standby position, and to be moved in a second movement direction (v2) from the standby position further in the actuating position direction if the handle part (10) is moved, coming from the standby position, into the actuating position, the first movement direction (v1) and the second movement direction (v2) being different and thus enclosing an angle ρ.

6. The motor vehicle door (100) as claimed in claim 5, at least two abutment surfaces (31.1, 32.1) enclosing with the direction of the transverse play an angle γ of less or greater than 90° and being angled with respect to the first movement direction (v1) by an angle α.

7. The motor vehicle door (100) as claimed in claim 6, the at least two abutment surfaces (31.1, 32.1) additionally being angled with respect to the second movement direction (v2) by an angle β and thus being angled with respect to each of the first and second movement directions (v1, v2).

8. The motor vehicle door (100) as claimed in claim 2, the means for reducing the transverse play (s) having at least four projection elements (31, 32) with abutment surfaces (31.1, 32.1), two projection elements (31) of the four projection elements (31, 32) being fixedly arranged in an offset or aligned manner on the vehicle door side and in the direction of the transverse play (s) to be reduced, and two other projection elements (32) of the four projection elements (31, 32) being fixedly arranged in an offset or aligned manner on the mechanism (20) or on the handle part (10) itself in the direction of the transverse play (s) to be reduced, and the two projection elements (32) arranged on the handle part (10) or the mechanism (20) being interconnected via a connecting web (33), and the corresponding other two projection elements (31) being configured to be moved in an offset or aligned manner between the projection elements (32) interconnected via the connecting web (33) by means of at least two different relative movement directions (v1, v2).

9. The motor vehicle door as claimed in claim 8, the corresponding other two projection elements (31) being arranged on an edge (41) of a vehicle-door-side component on the upper and lower side of the component and the connecting web (33) bridging the edge (41) and the connecting web (33) positioning the projection elements (32) interconnected by the connecting web (33) over the upper side and under the lower side of the component.

10. An actuating device (1) for a door lock of a motor vehicle door, comprising:

a handle part (10) which can be gripped by one hand, the handle part (10) being movable via a mechanism (20) from a rest position (P0) into a standby position (P1), and the handle part (10) being movable manually into an actuating position (P2) starting from the standby position (P1), the actuating device (1) being configured to actuate the door lock if the handle part (10) reaches or has reached the actuating position (P2), the actuating device (1) having a means for reducing a transverse play (s) of the handle part (10), and, by virtue of the means (30) for reducing the transverse play, the transverse play (s) in the standby position (P1) is reduced with respect to the transverse play (s) in a position between the rest position (P0) and the standby position (P1), wherein the means (30) for reducing the transverse play of the handle part (10) is configured to completely or partially cancel again the reduction of the transverse play (s) in the standby position (P1) if the handle part (10) is moved from the standby position (P1) into the actuating position (P2).

* * * * *